US006971417B2

(12) United States Patent
Deni

(10) Patent No.: US 6,971,417 B2
(45) Date of Patent: Dec. 6, 2005

(54) APPARATUS FOR EVACUATING BAGS

(75) Inventor: Leonard A. Deni, Clarence, NY (US)

(73) Assignee: Keystone Manufacturing Co., Inc., Buffalo, NY (US)

( * ) Notice: Subject to any disclaimer, the term of this patent is extended or adjusted under 35 U.S.C. 154(b) by 0 days.

(21) Appl. No.: 10/605,711

(22) Filed: Oct. 21, 2003

(65) Prior Publication Data

US 2005/0081948 A1 Apr. 21, 2005

Related U.S. Application Data

(60) Provisional application No. 60/420,262, filed on Oct. 22, 2002.

(51) Int. Cl.[7] ..... B65B 1/04

(52) U.S. Cl. ..... 141/65; 141/114

(58) Field of Search ..... 141/65, 67, 98, 141/95, 114, 313–316, 392, 351

(56) References Cited

U.S. PATENT DOCUMENTS

| | | | | |
|---|---|---|---|---|
| 4,678,014 | A * | 7/1987 | Owen et al. | 141/67 |
| 4,775,302 | A | 10/1988 | Neward | |
| 4,806,084 | A | 2/1989 | Neward | |
| 4,954,054 | A | 9/1990 | Neward | |
| 4,979,883 | A | 12/1990 | Neward | |
| 5,011,381 | A | 4/1991 | Neward | |
| 5,205,726 | A | 4/1993 | Neward | |
| 5,362,214 | A | 11/1994 | Neward | |
| 5,422,560 | A * | 6/1995 | Yan | 320/160 |
| 5,478,216 | A | 12/1995 | Neward | |
| 5,765,608 | A | 6/1998 | Kristen | |
| 6,499,385 | B2 | 12/2002 | Protti | |
| 6,598,626 | B2 * | 7/2003 | Chaffee | 141/65 |
| 6,662,831 | B2 * | 12/2003 | Chen | 141/65 |

* cited by examiner

*Primary Examiner*—Steven O. Douglas
(74) *Attorney, Agent, or Firm*—Simpson & Simpson, PLLC

(57) ABSTRACT

An apparatus for evacuation of a storage bag is disclosed. The apparatus comprises a case, a flange mounted on the case, a fan, and a motor operatively arranged to drive said fan.

6 Claims, 7 Drawing Sheets

APPARATUS FOR EVACUATING BAGS

CROSS REFERENCE TO RELATED APPLICATIONS

This application claims the benefit under 35 U.S.C. §119 (e) of U.S. Provisional Application No. 60/420,262, filed Oct. 22, 2002.

FIELD OF THE INVENTION

This invention relates to the evacuation of storage bags. More specifically it relates to a portable apparatus for the evacuation of plastic storage bags. Even more specifically, the present invention relates to a hand-held apparatus for the evacuation of plastic storage bags having a one-way valve.

BACKGROUND OF THE INVENTION

Flexible plastic bags can be used to protect objects stored for extended periods of time. However, these bags can cause the storage space taken up by the object to increase. One solution is to evacuate the air from the bag so that the bag fits closely over the surface of the object. In fact, if the object is compressible like clothing, an evacuated bag will take up less space than the object alone. Various bags have been designed to allow air to be evacuated therefrom after an object is secured therein.

For example, U.S. Pat. Nos. 6,408,872, 6,357,915, 6,116,781, 5,931,189, and 5,480,030 and United States Patent Application Nos. 20020117215, 20020079242, 20020009240, and 20020090151 all disclose bags with one-way valves for storing objects therein. Each of the bags is arranged to be evacuated by physical pressure on the outside of the bag, or by attachment of a conventional vacuum cleaner to the one-way valve. Neither of these evacuation means are satisfactory for a traveler trying to increase the amount of clothing carried in a suitcase. Evacuation by physical pressure tends to wrinkle the clothing therein. Evacuation by attachment of a conventional vacuum cleaner can be done at home, but a vacuum cleaner compatible with the valve may not be available when the traveler is repacking.

Clearly, then, there is a longfelt need for a hand-held, portable apparatus for evacuation of storage bags.

SUMMARY OF THE INVENTION

The present invention broadly comprises a method and apparatus for the evacuation of storage bags. The apparatus comprises a case, a flange mounted on the case, a fan, and a motor operatively arranged to drive the fan.

A general object of the present invention is to provide an apparatus for evacuation storage bags.

Another object of the present invention is to provide a hand-held, portable apparatus.

These and other objects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE PREFERRED EMBODIMENT

It should be appreciated that, in the detailed description of the invention which follows, like reference numbers on different drawing views are intended to identify identical structural elements of the invention in the respective views.

Figure 1:
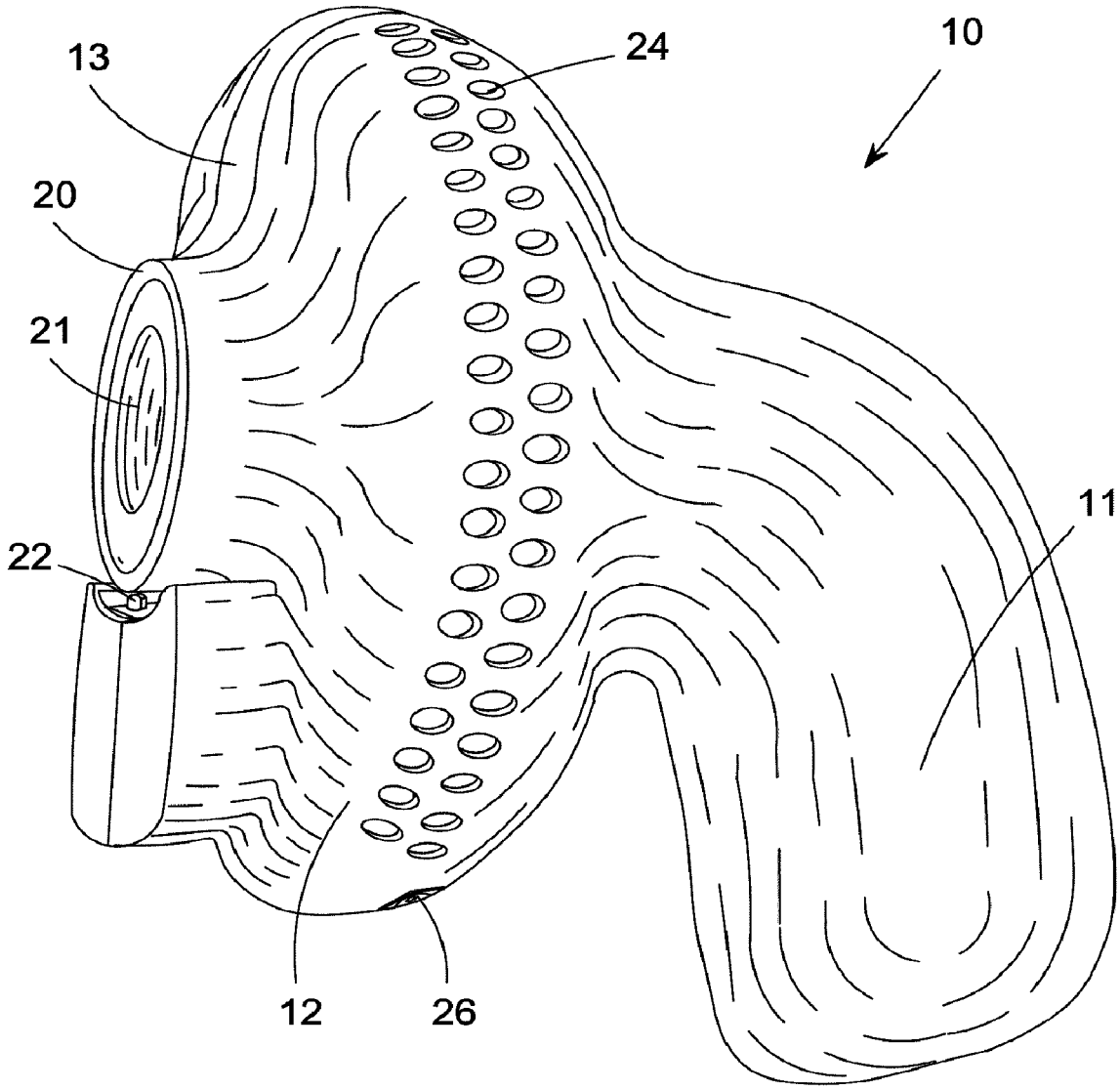
FIG. 1 is a perspective view of an embodiment of the present invention.
Figure 3:
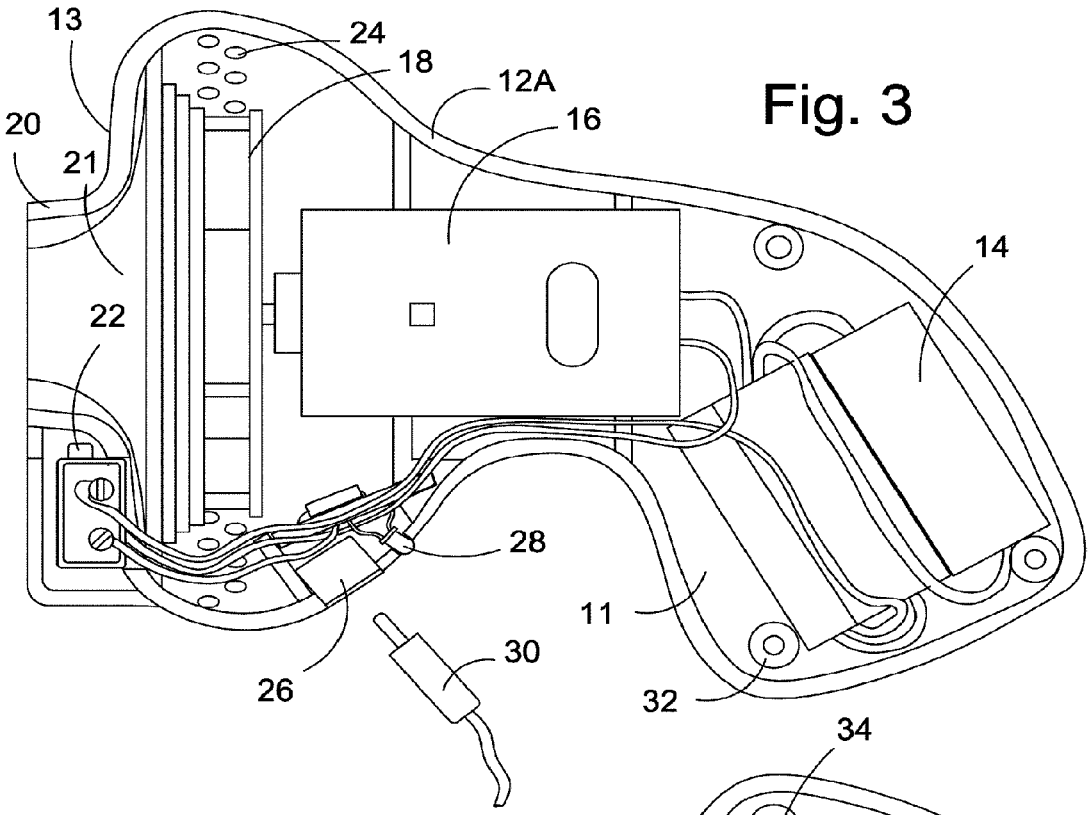
FIG. 3 is a side view of an embodiment of the present invention with the case opened.
Figure 4:
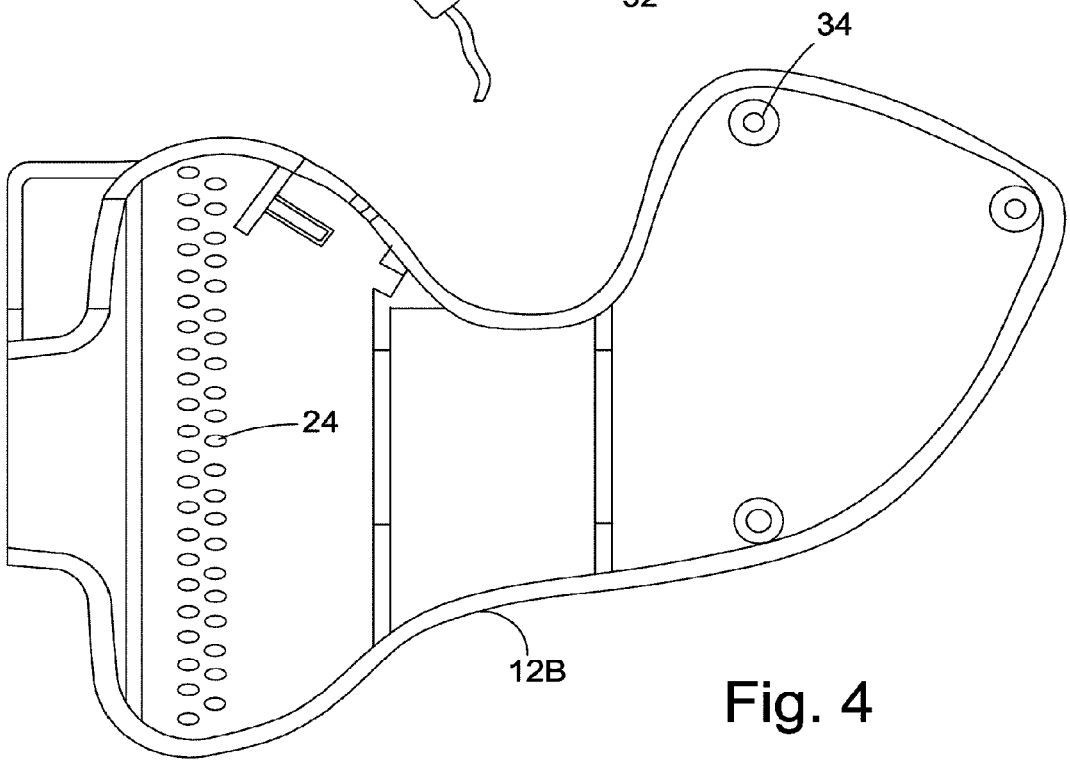
FIG. 4 is a side view of the open case of an embodiment of the present invention.
Figure 5:
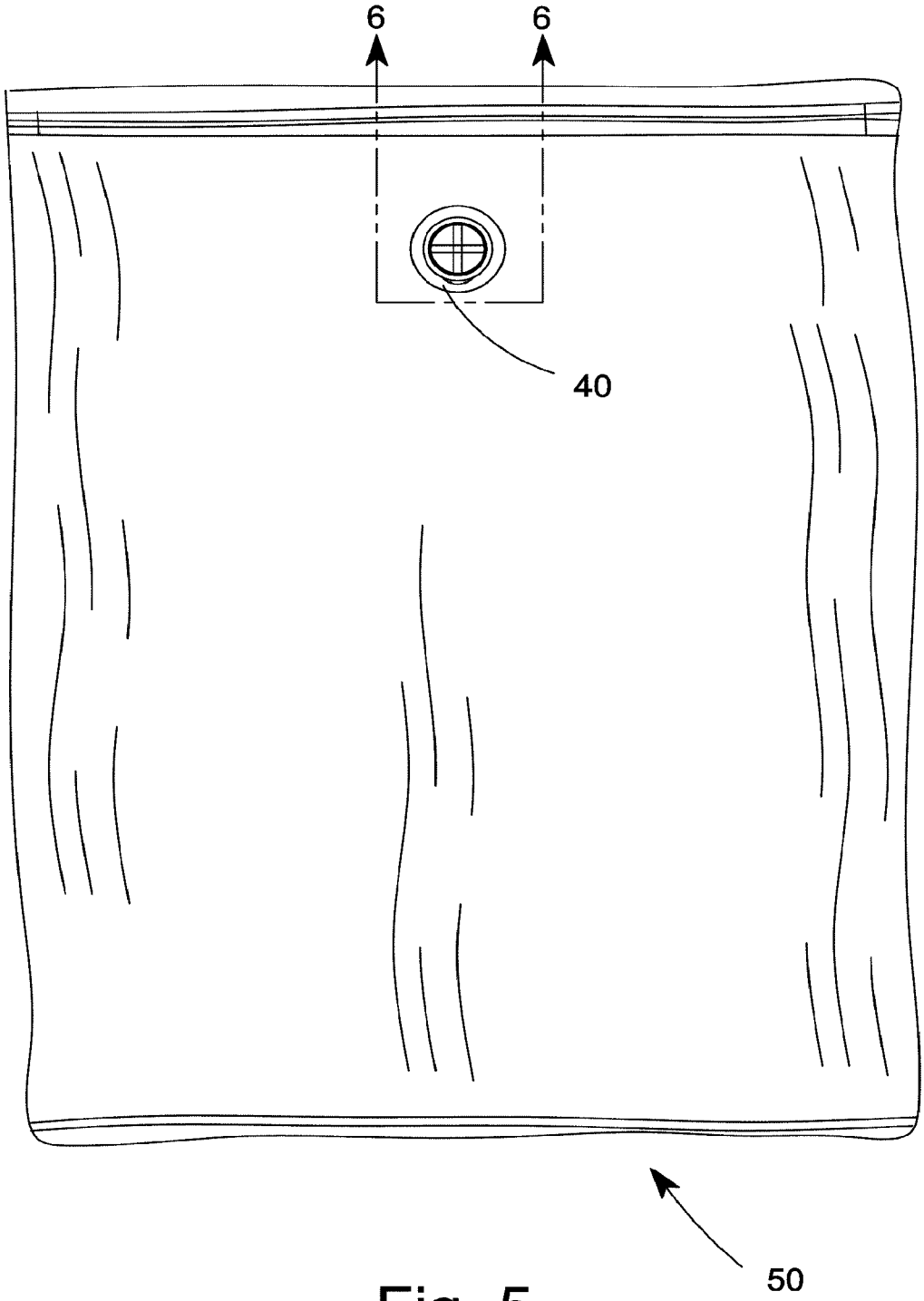
FIG. 5 is a front view of a bag having a flange operatively arranged to couple with the flange of the present invention.

An illustration of an embodiment of the present invention is shown in FIG. 1 and designated 10. As shown in FIG. 3, apparatus 10 comprises case 12, containing batteries 14, motor 16, and fan 18, and flange 20. Handle 11 of case 12 allows the invention to be held by a user. In the embodiment shown, case 12 is disassembled by separating case members 12A and 12B. In the embodiment shown, receptacles 32 in case member 12A receive fasteners, such as screws, extending through holes 34 in case member 12B shown in FIG. 4. However, it should be readily apparent to one skilled in the art that other means of securing the case are possible, and these modifications are within the spirit and scope of the invention as claimed. Also in the embodiment shown, batteries 14 comprise 3 1.2 V Ni—Cd sub C size rechargeable batteries. However, it should be readily apparent to one skilled in the art that other power sources such as rechargeable batteries having different sizes, non-rechargeable batteries, or an AC power connection could be used, and these modifications are within the spirit and scope of the invention as claimed.

Figure 2:
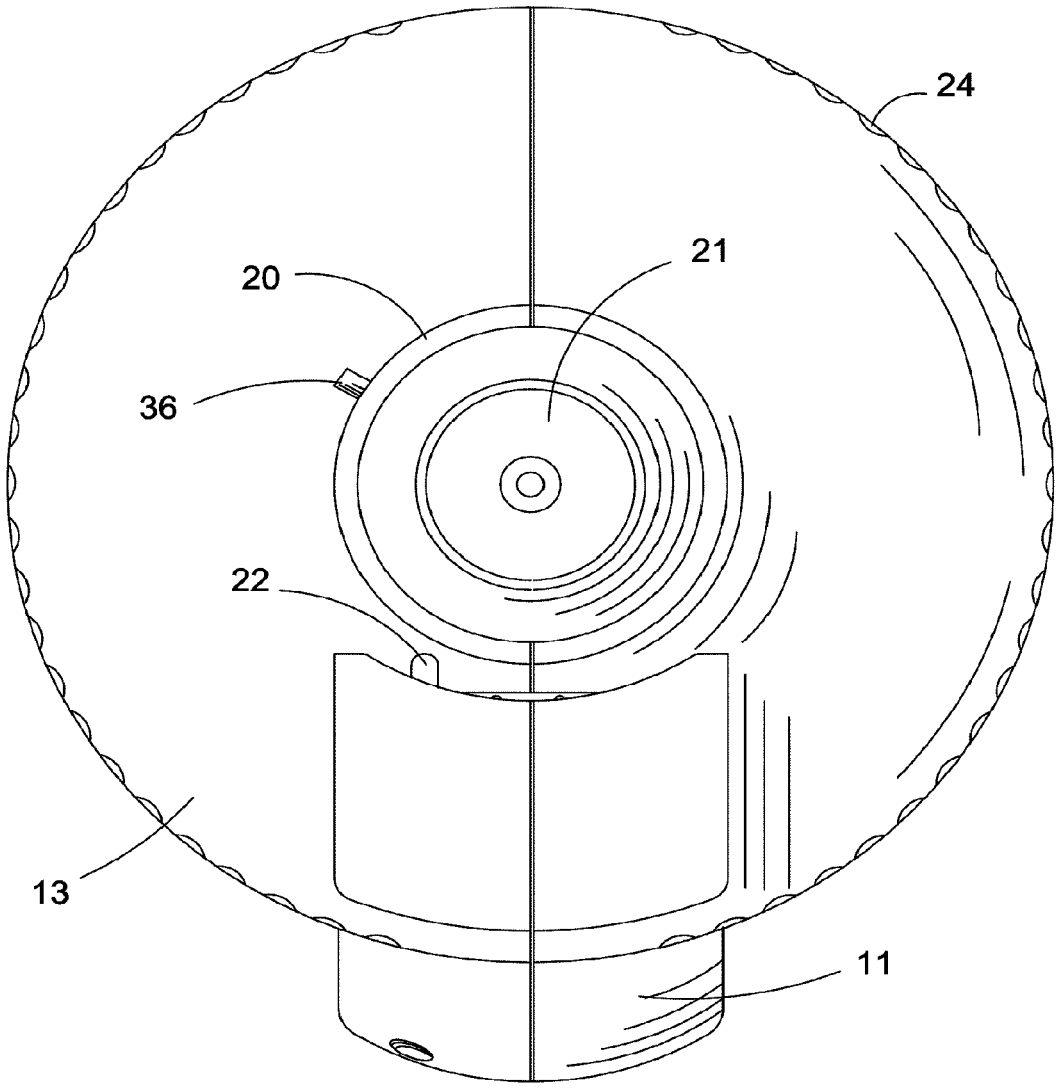
FIG. 2 is a front view of an embodiment of the present invention.
Figure 6:
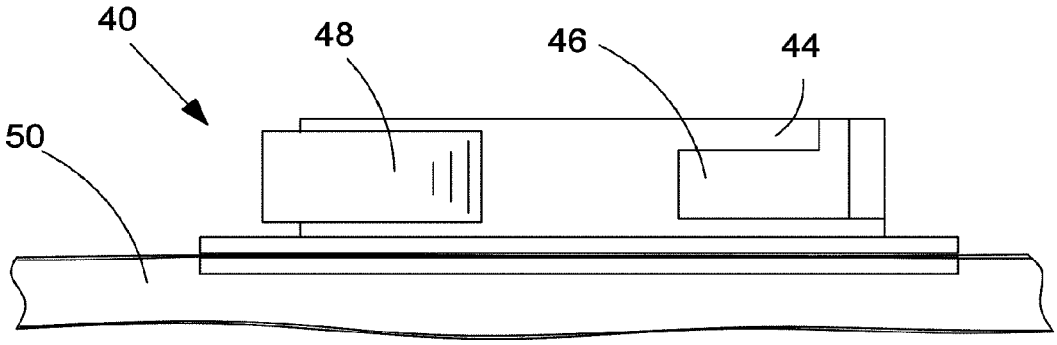
FIG. 6 is a side view of a valve operatively arranged to couple with a flange of the present invention.
Figure 7:
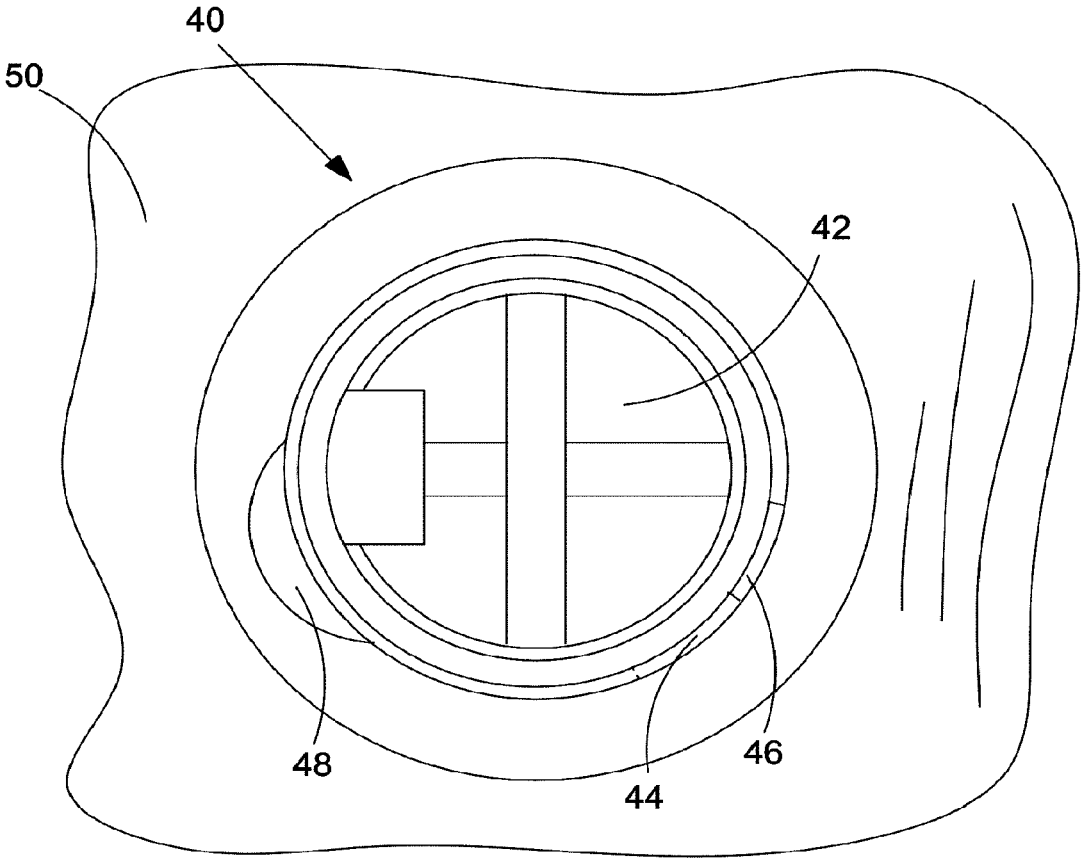
FIG. 7 is a front view of a valve operatively arranged to couple with a flange of the present invention.

Flange 20 is located on face 13 of case 12. Flange 20 is operatively arranged to be coupled with one-way valve 40 on storage bag 50. Examples of such valves are shown in U.S. Pat. Nos. 6,408,872, 6,357,915, 6,116,781, 5,931,189, and 5,480,030 and United States Patent Application Nos. 20020117215, 20020079242, 20020009240, and 20020090151, all of which are incorporated by reference herein. In one embodiment, the flange is operatively arranged to lock with the valve when the valve is rotated with respect to the flange. This is achieved by the insertion of member 36 located on flange 20 (FIG. 2) into slot 46 of valve 40 (FIGS. 6 and 7). When the valve is rotated with respect to the flange, member 36 slides under member 44 of valve 40, locking valve 40 and flange 20 together in a coupled configuration. At the same time, member 48 of valve 40 depresses switch 22 of the present invention, located proximate flange 20 (FIG. 2). It should be readily apparent to one skilled in the art that the valve does need to be locked to the flange, as the valve will be drawn to the flange due to the suction created by fan 18. Modifications wherein the valve is not locked to the flange are possible, and these modifications are within the spirit and scope of the invention as claimed.

Switch 22 activates motor 16. In the embodiment shown in FIGS. 1–9, switch 22 is operatively arranged to be activated by the valve when the valve is coupled to the flange. However, embodiments wherein the switch is manually activated by a user are possible, and these modifications are intended to be within the spirit and scope of the invention as claimed.

When switch 22 is activated, current from batteries 14 flows through motor 16. Motor 16 then rotates fan 18. Fan 18 is operatively arranged to draw air from outside the case through opening 21 of flange 20. When a valve is coupled to flange 20, air is drawn through the valve, evacuating the bag. Air vents 24 allow the air drawn through flange 20 to exit the case.

As shown in FIG. 3, AC cord adaptor 26 receives AC cord 30. When AC cord 30 is plugged into an AC outlet, batteries 14 are recharged. When batteries 14 are recharging, indicator 28 is lit. When the batteries are fully charged, indicator 28 is not lit. In a preferred embodiment, indicator 28 is a light emitting diode (LED).

Figure 8:
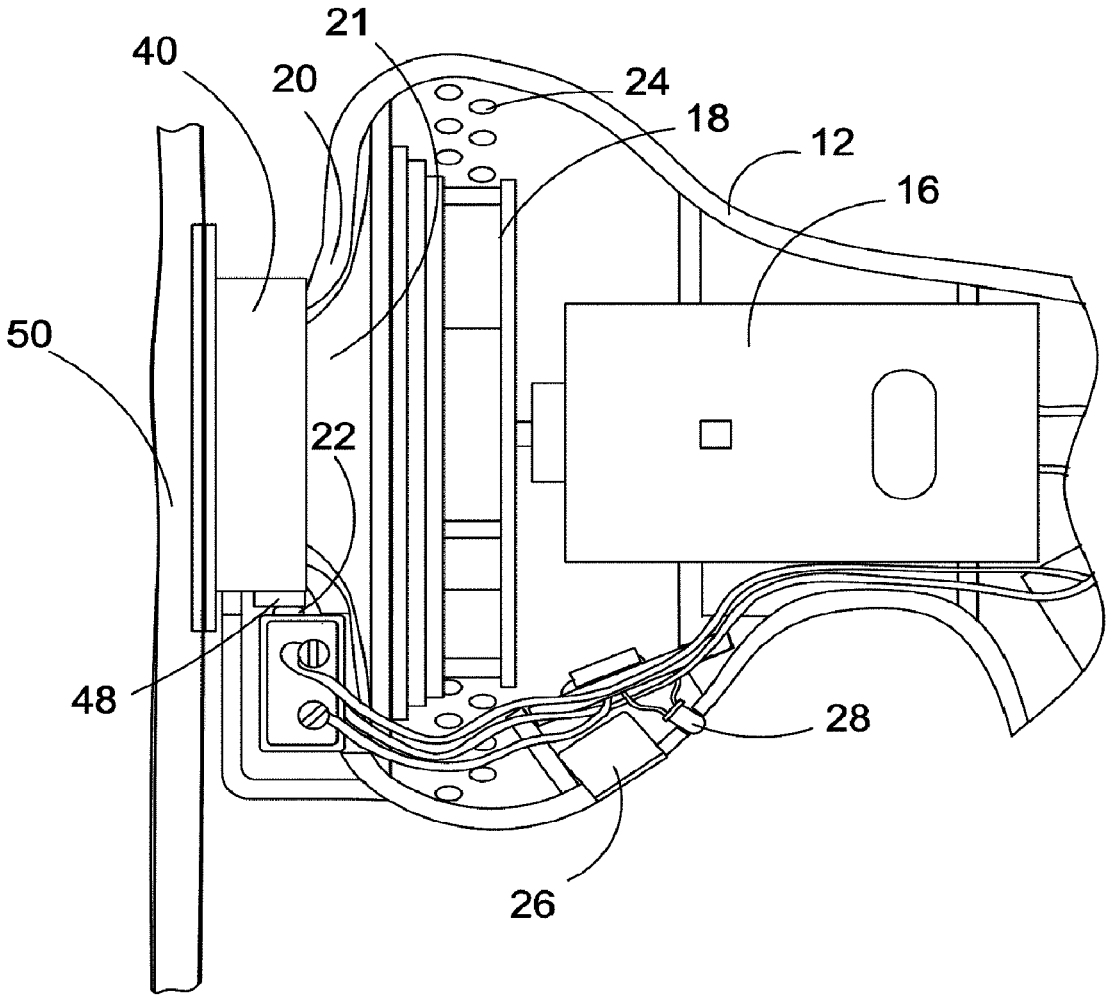
FIG. 8 is a side schematic view showing the present invention evacuating a bag; and, FIG. 9 is a perspective view of an embodiment of the present invention and a bag to be evacuated.
Figure 9:
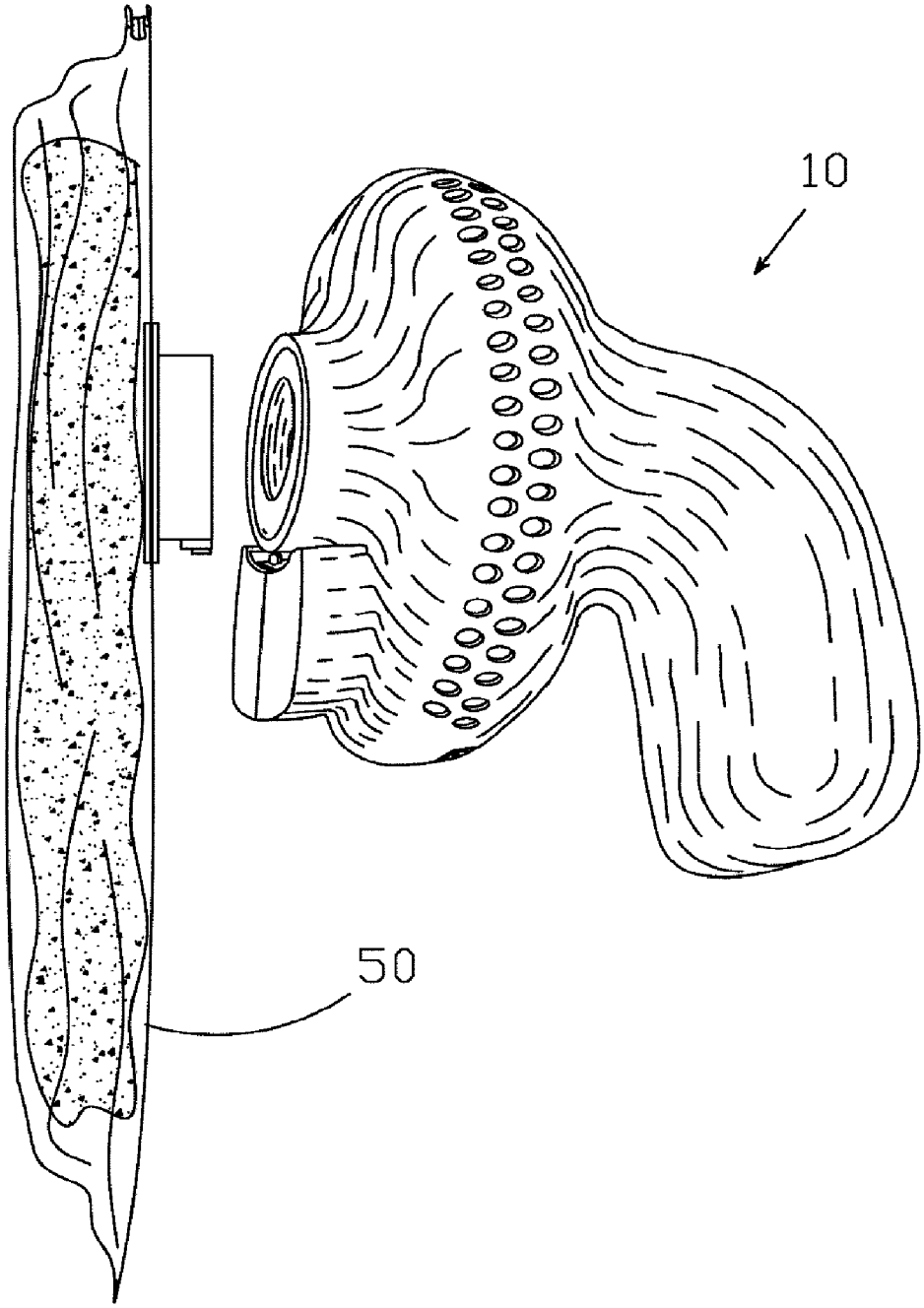

To operate apparatus 10, valve 40 of sealed bag 50 is coupled to flange 20, as illustrated in FIG. 8. Valve 40 activates switch 22. This activates motor 16, which rotates fan 18. Fan 18 draws air out of bag 50, through valve 40 and through opening 21 of flange 20. The air exits the inside of case 12 through vents 24. When bag 50 is evacuated, the valve 40 is decoupled from flange 20, deactivating switch 22. Motor 16 stops rotating fan 18.

Thus, it is seen that the objects of the present invention are efficiently obtained, although modifications and changes to the invention should be readily apparent to those having ordinary skill in the art, and these modifications are intended to be within the spirit and scope of the invention as claimed.

What is claimed is:

1. An apparatus for evacuation of a storage bag comprising:

a case;

a flange fixedly mounted on said case, said flange operatively arranged to couple with a valve on said storage bag and said flange comprising a flat annular ring operatively arranged to form a seal with said valve;

a fan, said fan operatively arranged to draw air through said flange and through said coupled valve; and, a motor operatively arranged to drive said fan.

2. The apparatus recited in claim 1 further comprising:

a switch, said switch operatively arranged to be actuated by said valve of said storage bag when said storage bag is coupled to said flange, said switch enabling said motor to receive power when said switch is actuated.

3. The apparatus recited in claim 1 further comprising:

rechargeable batteries operatively arranged to supply power to said motor, said batteries operatively arranged to be recharged by an AC power connection.

4. The apparatus recited in claim 3 further comprising an indicator operatively arranged to indicate when said batteries are recharging.

5. The apparatus recited in claim 4 wherein said indicator is a light emitting diode.

6. An apparatus for evacuation of a storage bag comprising:

a case;

a flange fixedly mounted on said case, said flange operatively arranged to couple with a valve on said storage bag;

a fan, said fan operatively arranged to draw air through said flange and through said coupled valve;

a motor operatively arranged to drive said fan; and, a switch, said switch operatively arranged to be actuated by said valve of said storage bag when said storage bag is coupled to said flange, said switch enabling said motor to receive power when said switch is actuated.

* * * * *